US007856931B2

(12) United States Patent
Gillis

(10) Patent No.: US 7,856,931 B2
(45) Date of Patent: Dec. 28, 2010

(54) CENTER SILL FOR RAILROAD FREIGHT CAR

(75) Inventor: Michael Gillis, Portland, OR (US)

(73) Assignee: Gunderson LLC, Portland, OR (US)

( * ) Notice: Subject to any disclaimer, the term of this patent is extended or adjusted under 35 U.S.C. 154(b) by 63 days.

(21) Appl. No.: 12/315,164

(22) Filed: Nov. 25, 2008

(65) Prior Publication Data

US 2010/0126375 A1 May 27, 2010

(51) Int. Cl.
*B61D 17/00* (2006.01)

(52) U.S. Cl. ..... 105/416; 105/413; 105/247; 105/251; 105/245

(58) Field of Classification Search ..... 105/416, 105/413, 247, 251, 245
See application file for complete search history.

(56) References Cited

U.S. PATENT DOCUMENTS

| | | | | |
|---|---|---|---|---|
| 1,066,546 | A | | 7/1913 | Summa |
| 1,115,861 | A | | 11/1914 | Parke |
| 1,279,600 | A | | 9/1918 | Slick |
| 1,881,797 | A | | 10/1932 | Martin |
| 1,950,001 | A | | 3/1934 | Gilpin et al. |
| 2,079,552 | A | | 5/1937 | Fenstermacher et al. |
| 2,079,862 | A | | 5/1937 | Kiesel, Jr. |
| 2,092,457 | A | | 9/1937 | Kiesel, Jr. |
| 2,125,692 | A | | 8/1938 | Ragsdale et al. |
| 2,620,751 | A | | 12/1952 | Watter |
| 2,862,461 | A | | 12/1958 | Nystrom |
| 3,040,679 | A | | 6/1962 | Warntz |
| 3,339,499 | A | | 9/1967 | Charles at al. |
| 3,490,387 | A | | 1/1970 | Halcomb |
| 3,495,548 | A | | 2/1970 | Rollins |
| 3,509,827 | A | | 5/1970 | Sutter |
| 3,515,051 | A | | 6/1970 | Pulcrano |
| 3,538,857 | A | * | 11/1970 | Mowatt-Larssen ..... 105/247 |
| 3,557,713 | A | | 1/1971 | Spence et al. |
| 3,570,592 | A | | 3/1971 | Rollins |
| 3,577,932 | A | | 5/1971 | Pulcrano et al. |
| 3,583,330 | A | | 6/1971 | Freudman |
| 3,583,331 | A | | 6/1971 | Mowatt-Larsen |
| 3,583,564 | A | | 6/1971 | Rollins |
| 3,675,591 | A | | 7/1972 | Nagy et al. |
| 3,789,773 | A | | 2/1974 | McNalley et al. |
| 3,918,370 | A | | 11/1975 | Campbell et al. |
| 3,921,537 | A | | 11/1975 | Fleshman et al. |
| 4,003,319 | A | | 1/1977 | Campbell et al. |
| 4,168,665 | A | | 9/1979 | Needham et al. |
| 4,232,989 | A | | 11/1980 | Miller |
| 4,262,602 | A | | 4/1981 | Patil et al. |
| 4,292,898 | A | | 10/1981 | Gordon et al. |
| 4,334,481 | A | | 6/1982 | Przybylinski et al. |
| 4,352,331 | A | | 10/1982 | Anderson et al. |

(Continued)

*Primary Examiner*—S. Joseph Morano
*Assistant Examiner*—Jason C Smith
(74) *Attorney, Agent, or Firm*—Chernoff, Vilhauer, McClung & Stenzel, LLP

(57) ABSTRACT

A center sill for inclusion in a center sill assembly of a railroad freight car. The center sill includes a first main structural member of metal plate bent to a three-sided shape including a bottom cover and a pair of side web portions, and a top cover plate fastened to the side web portions to form a box beam structure. Horizontal filler plates that may be of thicker material are fastened to the bottom cover portion at the ends. Stub sills may be attached to the ends of the center sill to form a center sill assembly for a freight car such as a hopper car.

17 Claims, 5 Drawing Sheets

U.S. PATENT DOCUMENTS 4,366,757 A 1/1983 Funk
4,377,058 A 3/1983 Hallam et al.
4,484,528 A 11/1984 Anderson et al.
4,493,266 A * 1/1985 Augustine, Jr. ..... 105/255
4,497,258 A 2/1985 Ruhmann et al.
4,498,400 A 2/1985 Vorwerk et al.
4,598,646 A 7/1986 Dugge et al.
4,608,931 A 9/1986 Ruhmann et al.
4,630,548 A * 12/1986 Wiger et al. ..... 105/416
4,638,743 A 1/1987 Loomis
4,696,088 A 9/1987 Miller
4,741,274 A 5/1988 Ferris et al.
4,875,417 A 10/1989 Coulborn et al.
4,884,511 A 12/1989 Hallam et al.
4,893,568 A 1/1990 Adams
4,898,101 A 2/1990 Harter
4,922,833 A 5/1990 Coulborn et al.
4,930,427 A 6/1990 Ritter et al.
4,941,411 A 7/1990 Wong
4,966,081 A 10/1990 Dominguez et al.
5,144,895 A 9/1992 Murray
5,159,882 A 11/1992 Krug et al.
5,259,322 A 11/1993 Dominguez et al.
5,263,421 A 11/1993 Lichty et al.
5,279,230 A 1/1994 Thomas et al.
5,367,958 A * 11/1994 Weiss et al. ..... 105/406.1
5,390,607 A 2/1995 Lydic
5,762,003 A 6/1998 Downes et al.
5,860,366 A * 1/1999 Lydic ..... 105/416
5,934,200 A 8/1999 Lydic
6,019,049 A * 2/2000 Gaydos et al. ..... 105/289
6,044,771 A 4/2000 Nguyen
6,067,912 A 5/2000 Miller
6,119,345 A * 9/2000 Lydic et al. ..... 29/897.2
6,220,502 B1 4/2001 Gallinger et al.
6,237,505 B1 5/2001 Sande et al.
6,244,191 B1 * 6/2001 Lydic ..... 105/377.07
6,276,058 B1 8/2001 Gallinger et al.
6,279,217 B1 8/2001 Gallinger et al.
6,279,487 B1 8/2001 Gaydos et al.
6,502,518 B1 1/2003 Miller
6,604,469 B1 8/2003 Galvan et al.
6,769,366 B1 * 8/2004 Lydic et al. ..... 105/416
2002/0157563 A1 10/2002 Richmond et al.
2004/0244638 A1 12/2004 Taylor
2005/0056185 A1 * 3/2005 Herzog et al. ..... 105/286
2005/0056186 A1 * 3/2005 Creighton et al. ..... 105/286
2008/0035014 A1 * 2/2008 Gillis et al. ..... 105/248
2009/0241799 A1 * 10/2009 Saxton et al. ..... 105/413

* cited by examiner

CENTER SILL FOR RAILROAD FREIGHT CAR

BACKGROUND

The present disclosure relates to railroad freight cars and, more particularly, to hopper cars having through center sills.

To accommodate the widely varying types of cargo that may travel over a railroad, rail cars of many different designs are manufactured, and in some instances a rail car will be specially designed to carry one specific type of cargo. One type of cargo that is often transported via railroad is cargo having bulk fluid properties, meaning commodities that, in bulk, exhibit fluid-like behavior. Examples of such commodities are grain, nuts, and cement, etc. Such bulk fluid cargo is typically transported in a hopper car that is specially designed to carry cargo having bulk fluid properties.

A hopper car usually includes one or more cargo-carrying bins, called cargo wells, which may be filled with grain or other bulk fluid cargo. The cargo is typically poured into the hopper car from the top and discharged from the bottom, through a respective discharge outlet at the bottom of each cargo well. Each discharge outlet is selectively closeable to permit the loading and transporting of the cargo. A discharge outlet is usually located approximately at the center of the cargo well that it empties. When the discharge outlet is opened, the bulk fluid cargo flows from the hopper car. To facilitate the flow of cargo towards these outlets while a hopper car is being emptied, each cargo well will usually include at least one pair of opposed slope sheets, that are slanted downwardly and inwardly towards the respective outlet at the center of the cargo well.

One specific type of hopper car is a through center sill hopper car. A hopper car, like other rail cars, is structurally supported by an undercarriage that includes a center sill extending longitudinally along the center line of the hopper car. A through center sill hopper car has a center sill that runs through the cargo wells of the hopper car, and the cargo in each cargo well thus can surround the center sill. In order to facilitate the flow of cargo around the center sill when the cargo is unloaded, the portion of a center sill within a cargo well is typically covered by a tent-like hood with sloping upper surfaces, so that the bulk fluid cargo does not collect on top of the center sill when the hopper car empties.

The center sill is a primary load-bearing structural member of the hopper car, extending longitudinally between and interconnecting stub sills at the ends of the car to complete a center sill assembly. The center sill is thus the longitudinally central portion of a center sill assembly. The center sill must be of a sufficiently sturdy construction to withstand not only the substantial standing weight of both the hopper car and the cargo it carries, but also the buff and draft forces and various bending and rotational stresses that are applied to the hopper car as it moves along a railroad track as part of a train.

In the past, a center sill was typically constructed of two pairs of opposed, parallel elongate pieces of steel plate or other similarly rigid material, joined as an elongate box beam. These individual members are usually welded together along the right-angle intersections between adjacent members, and are typically fashioned of steel ½-inch thick, or thicker, so as to withstand the aforementioned loads and stresses. Often, the center sill is further reinforced by a plurality of gussets or other reinforcements inside the center sill.

Unfortunately, the size of a traditional center sill previously has substantially added to the weight of the hopper car, and its construction as described above has required a substantial amount of time and labor by skilled welders. What is desired, therefore, is a new center sill structure that is lighter in weight than center sills in existing hopper cars of similar load capacity, and that can be manufactured more easily and economically, yet is able to durably withstand the same loads and stresses as do the center sills of existing hopper cars of similar carrying capacity.

SUMMARY OF THE DISCLOSURE

The structures and methods disclosed herein provide answers to some of the aforementioned needs and provide a center sill structure and a method for constructing a center sill as defined by the claims appended hereto.

As a principal feature of a center sill as disclosed herein, a first main structural member defines a bottom cover portion and a pair of parallel upwardly extending laterally spaced side web portions defined by longitudinal bends in a unitary plate, giving the first main structural member a three-sided U-shaped form, and a top cover plate is welded to upper margins of the side web members to form an elongate box beam.

As one feature of the center sill structure disclosed herein, the first main structural member may be of a relatively thin steel plate, conserving weight, and horizontal filler plates of thicker steel plate material may be fastened into place along the bottom cover portion of the first main structural member at each of the opposite ends of the center sill, where such thicker material is desirable in order to carry the higher loads that are expected there.

In one embodiment of a center sill constructed in accordance with the disclosure herein, a doubler plate may be fastened to the filler plate within an end of the box beam portion of the center sill.

In one embodiment of the center sill disclosed herein a doubler plate may be welded to the top cover plate of the center sill in a location where loads are expected to be concentrated.

As one aspect of a method of making a center sill according to the present disclosure a part of the bottom cover portion of the first main structural member may be cut away prior to bending the plate into the U-shaped three sided form.

The foregoing and other features of the structures and methods disclosed herein will be more readily understood upon consideration of the following detailed description of embodiments, taken in conjunction with the accompanying drawings.

DETAILED DESCRIPTION OF EMBODIMENTS

Figure 1A:
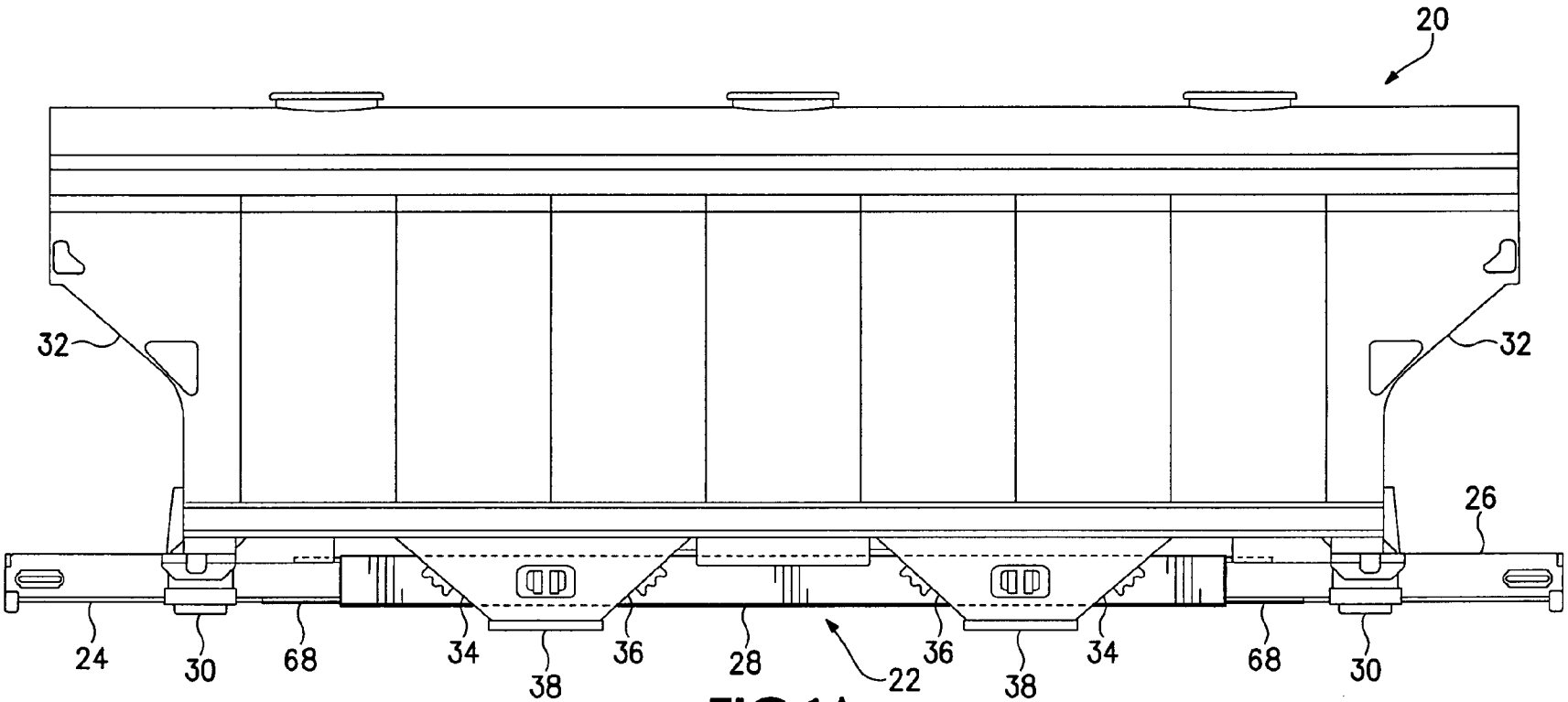
FIG. 1A is a side elevational view of a covered hopper car body including a center sill assembly embodying aspects of the present invention.

Referring first to FIG. 1A, a covered hopper car body 20 includes a center sill assembly 22 of which a stub sill 24 and a stub sill 26 are interconnected with each other through a center sill 28. Each of the stub sills 24 and 26 includes a center bearing 30 arranged to be supported by a respective wheeled truck (not shown), to carry the car body 20. The car body 20 includes a pair of cargo wells, or hoppers 32, and the center sill 28 extends through the hoppers 32 in the usual central, longitudinally-extending location.

The hoppers 32 include slope sheets 34 and 36 whose lower portions are pierced by and connected with the center sill 28, enabling portions of the train load forces to be carried by the portions of the car body 20 adjacent to the center sill 28.

Figure 1B:
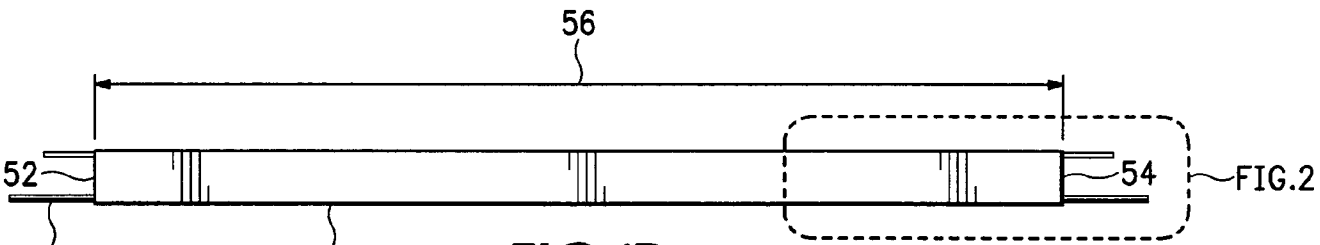
FIG. 1B is a side elevational view of the central, or center sill, portion of the center sill assembly of the car body shown in FIG. 1A.

FIG. 1B shows the center sill 28 apart from the car body 20. A portion of the center sill 28 is encircled by broken line to indicate a portion of the center sill 28 that is shown at an enlarged scale in FIGS. 2-6.

As may be seen in FIGS. 2-6, the general form of the center sill 28 is, like other center sills, a box beam. However, rather than being fashioned by welding four separate flat plates together, the center sill 28 includes a first main structural member 42 that may be of plate steel having a thickness 44 of, for example, ⅜ inch, which is thinner than the plates typically welded together previously as a box beam center sill. The first main structural member 42 is bent into a three-sided U-shaped form, as shown best in FIG. 6, to include a pair of side web portions 46 and 48, spaced apart from each other by a separation distance 49, and a bottom cover portion 50. The first main structural member 42 has a pair of opposite ends 52 and 54 defining a length 56. A top cover plate 58 extends transversely between the side webs 46 and 48 and along upper margins 60 of the side webs 46 and 48, parallel with the bottom cover portion 50, forming a closed, rectangular, box beam structure. The top cover plate 58 may, like the first main structural member 42, be of steel plate with a thickness 62 of ⅜ inch. Although the center sill 28 is shown with the top cover plate 58 parallel with the bottom cover portion, it will be understood that in some cases it may be desirable for the side web portions 46 and 48 to be tapered and for the top cover plate 58 to slope accordingly along the length 56 of the center sill 28.

The top cover plate 58 may extend longitudinally beyond the ends 52, 54, of the webs 46, 48 by a distance 64, such as about 13 inches, so as to be able to be joined to the stub sills 24 and 26 in completing the center sill assembly previously mentioned.

Figures 2, 3, 4, 5:
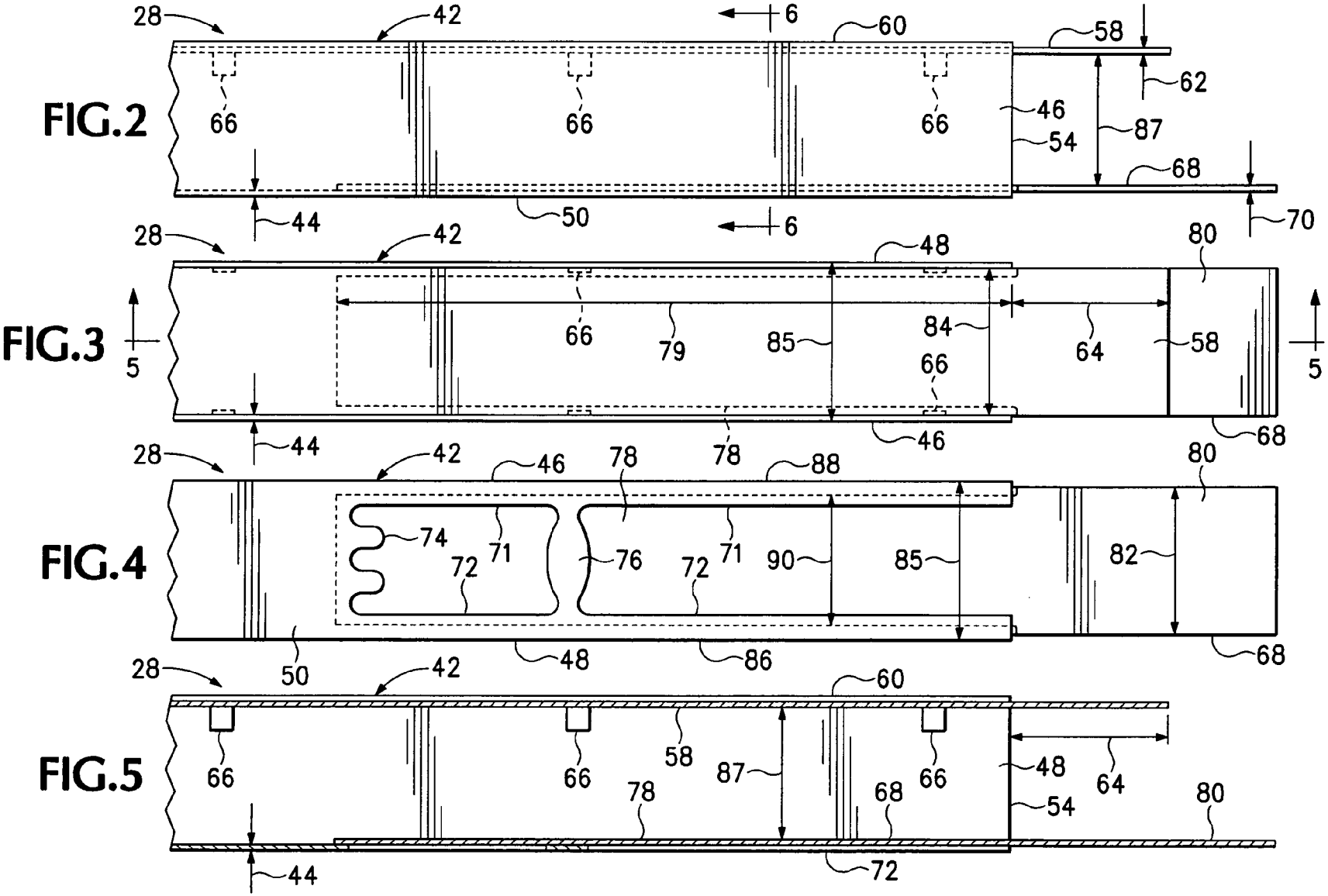
FIG. 2 is a side elevational view of the portion of the center sill outlined in broken line in FIG. 1B, at an enlarged scale.
FIG. 3 is a top plan view of the portion of a center sill shown in FIG. 2.
FIG. 4 is a bottom plan view of the portion of a center sill shown in FIGS. 2 and 3.
FIG. 5 is a sectional view of the portion of a center sill shown in FIGS. 2 and 3, taken along line 5-5 of FIG. 3.
Figure 6:
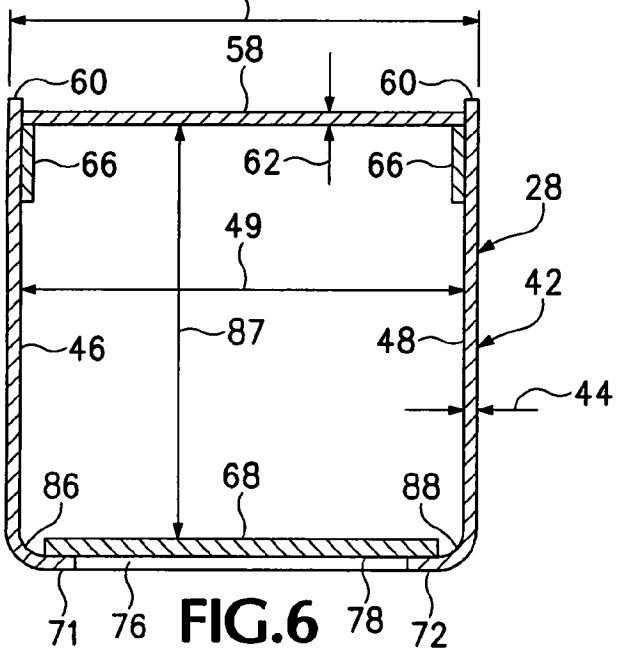
FIG. 6 is a sectional view of the portion of a center sill shown in FIG. 2, taken along line 6-6, at an enlarged scale.

Small locator plates 66 may be welded to the inner side of each of the webs 46 and 48 to support the top cover plate 58 in the desired location spaced upwardly apart from the bottom cover portion 50 as the top cover plate 58 is welded to the webs 46 and 48, as shown best in FIGS. 5 and 6. Although the center sill is shown in FIG. 6 as having a nearly square shape in section it will be understood that the side web portions 46 and 48 could also be deeper or shallower than shown, to form a center sill 28 that may be either narrower and deeper, or wider and shallower than the shape shown.

A respective reinforcing horizontal filler plate 68 rests atop and is fastened, as by being welded, to the bottom cover portion 50 adjacent to each end 52 and 54 of the center sill 28. A respective horizontal filler plate 68 may extend outward longitudinally from each end 52 and 54 of the center sill 28 to a greater distance 69, such as about 23 inches, than the distance 64 by which the top cover plate 58 extends beyond the ends 52 and 54. The filler plate 68 is provided to carry the heavier loads associated with that part of the bottom of the center sill 28 that is closest to the respective one of the stub sills 24 and 26, and so the horizontal filler plate 68 may have a thickness 70 of, for example, ½ inch, that is greater than the thickness 44.

In order to connect the filler plate 68 to the bottom cover portion 50 parts of the bottom cover portion 50 may be cut away, leaving flanges 71 and 72 and a sinuous end margin 74. A transverse strap 76 may be allowed to remain about 39 inches from the end 52 or 54, interconnecting the flanges 71 and 72 with each other and adding to the length along which a weld joint may be made. The horizontal filler plate 68 is welded to the margins of the flanges 71 and 72, the strap 76, and to the sinuous margin 74 that interconnects longitudinally inboard ends of the flanges 71 and 72.

A longitudinally inboard portion 78 of the horizontal filler plate 68 is narrower than a longitudinally outwardly extending portion 80. The inboard portion 78 may have a length 79 of, for example, about 60⅜ inches, and thus extends a short distance past the flanges 71 and 72 and the sinuous margin 74. The inboard portion 78 is narrow enough to fit closely atop the flanges 71 and 72 and between the side web portions 46 and 48, clear of any curvature of the first main structural member 42 between the bottom cover portion 50 and the webs 46 and 48. The wider outwardly extending portion 80, however, may have a width 82 equal to the separation distance 49 and thus equal also to the width 84 of the top cover plate 58, or may even be wider, depending on the design of the stub sill 24 or 26 to which it is to be joined.

The center sill 28 in the embodiment shown may have dimensions similar to those of a conventionally constructed center sill, with a width 85 of 13⅝ inches and an overall depth of 13⅜ inches, and with a vertical separation 87 of 11¾ inches between the facing surfaces of the top cover plate 58 and the filler plate 68, so as to mate with previously available stub sills 24 and 26. The top cover plate 58, horizontal filler member 68, and side web portions 46 and 48 at the ends 52 and 54 of the resulting center sill 28 can be welded to the stub sills 24 and 26 in substantially the same manner as has been conventionally used to join a center sill to stub sills.

Figure 7:
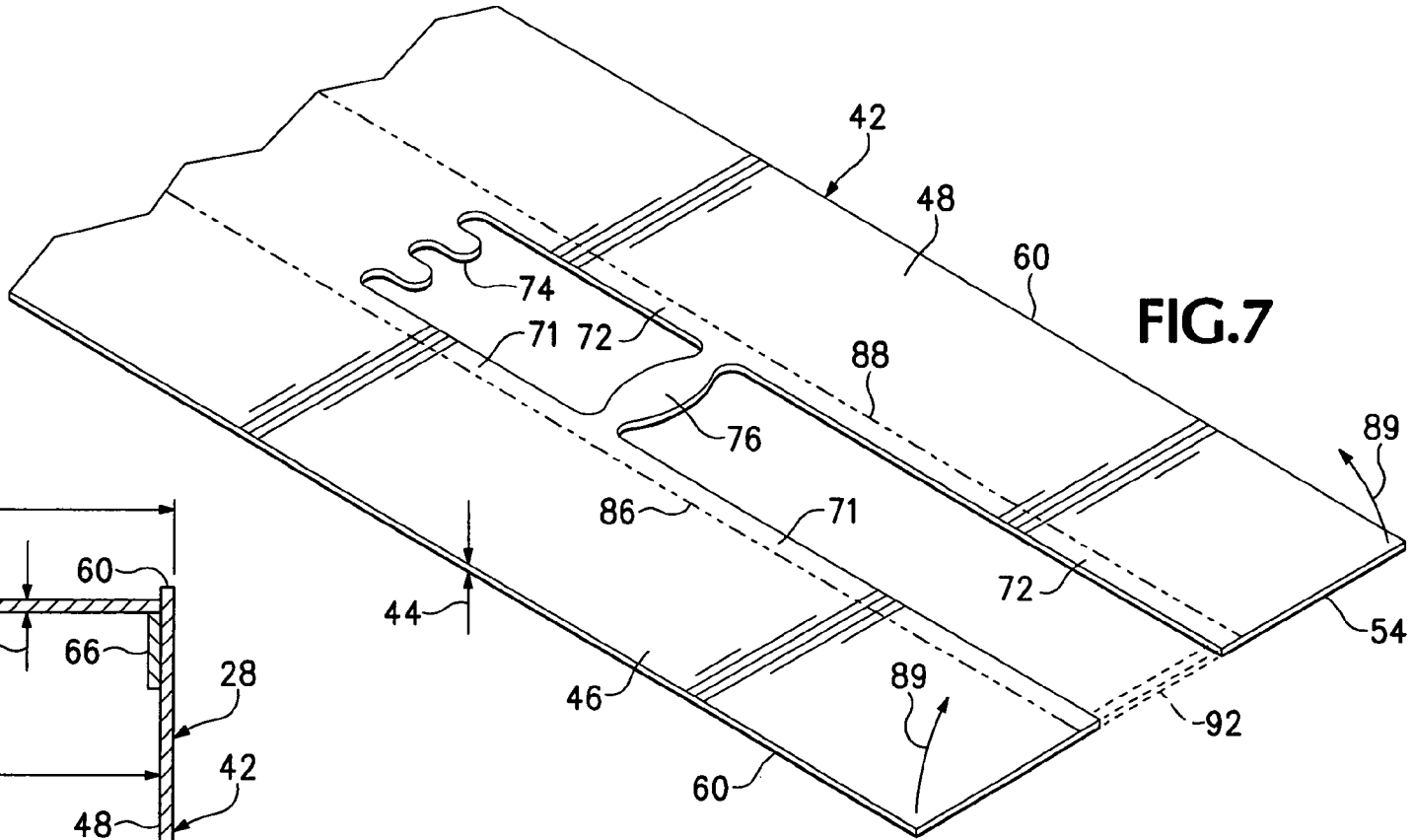
FIG. 7 is an isometric view of an end portion of a first main structural member of the portion of a center sill shown in FIGS. 2-6, in a flat condition prior to being bent to its final shape.
Figures 8, 9:
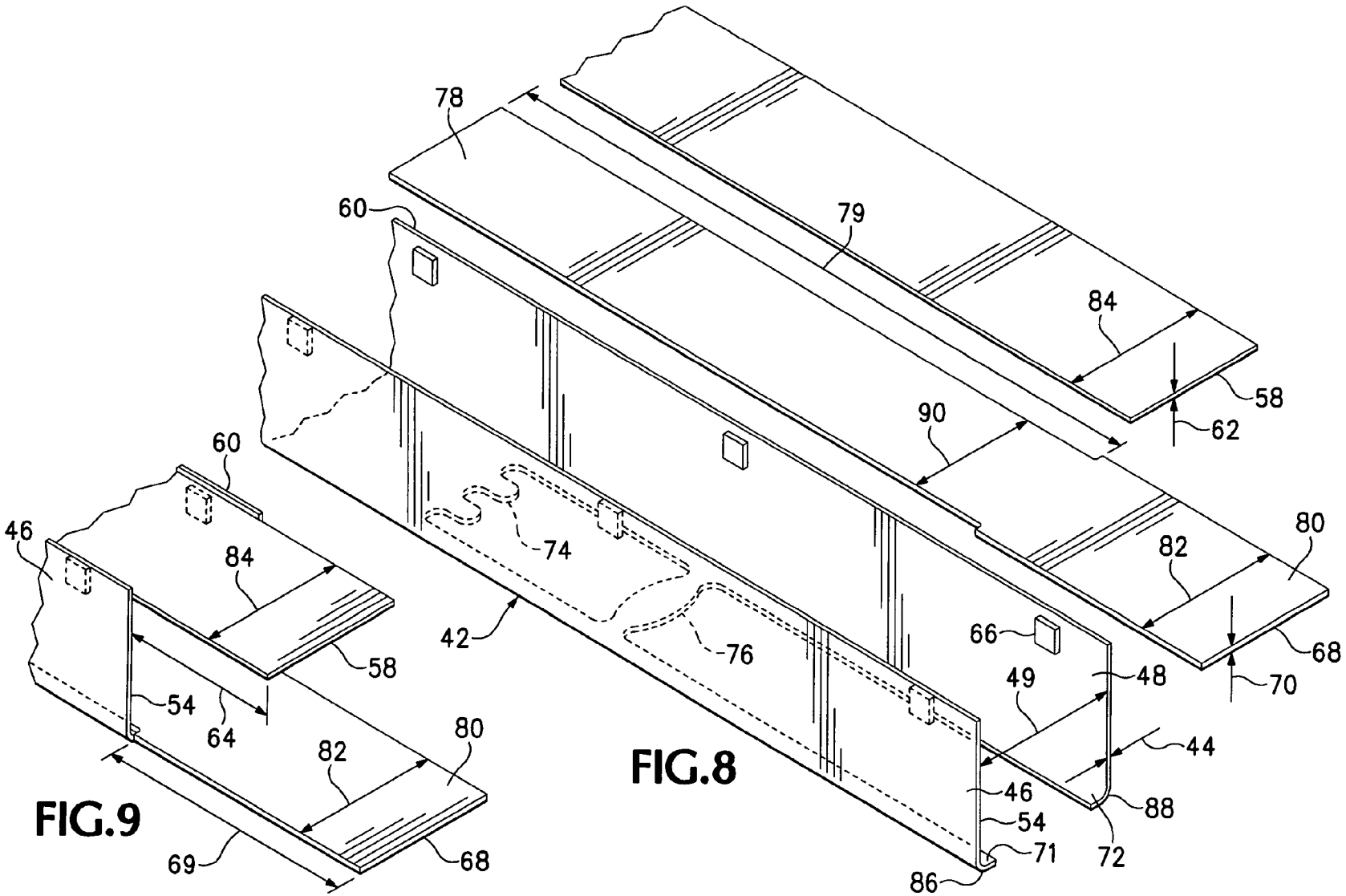
FIG. 8 is an exploded isometric view of the end portion of a center sill shown in FIGS. 2-6.
FIG. 9 is an isometric view from the upper right of the end portion of a center sill shown in FIGS. 2-6 and 8, after assembly of the components shown in FIG. 8.
Figures 10, 11, 12, 13, 14:
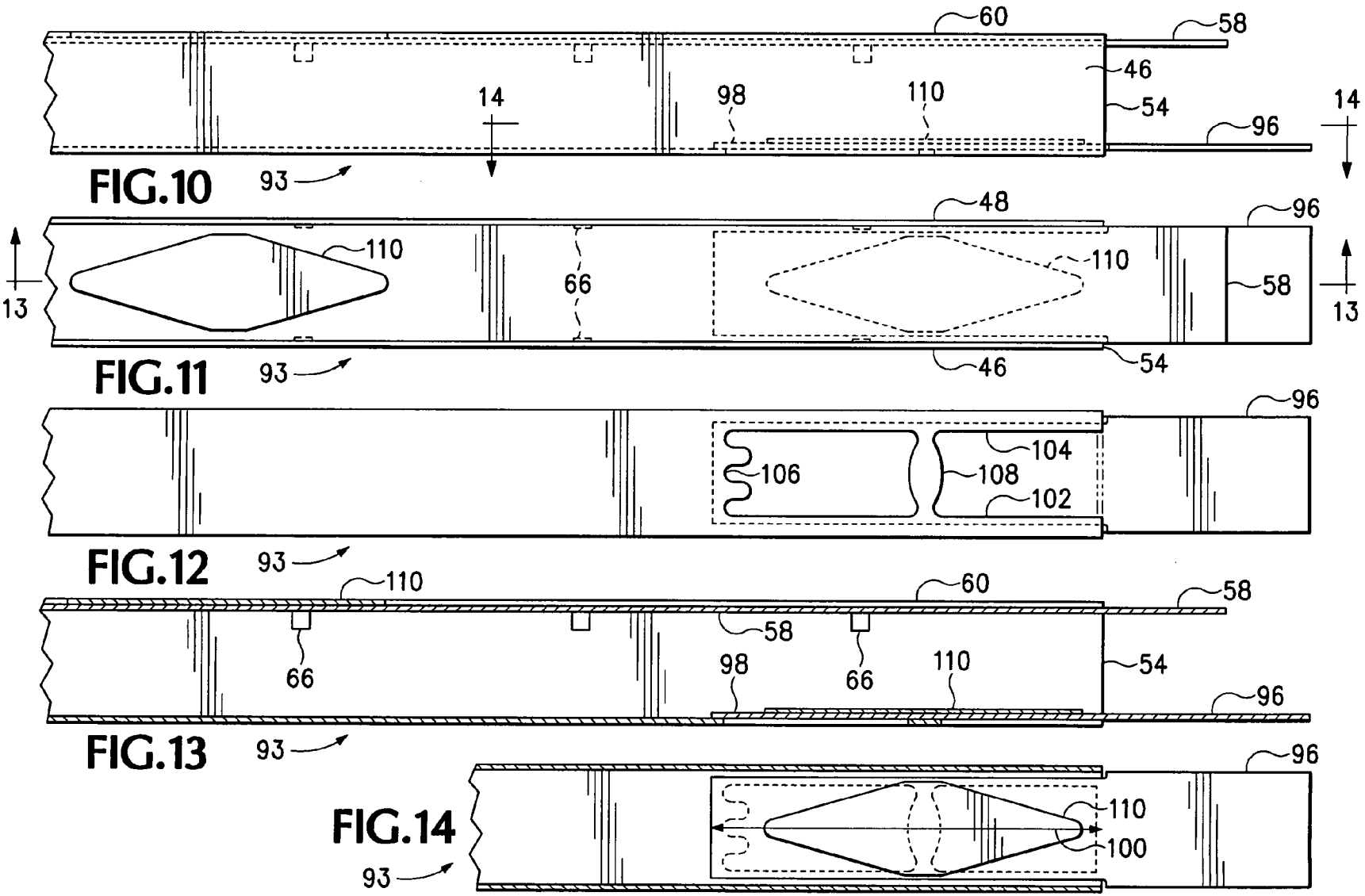
FIG. 10 is a side elevational view of a portion of a center sill that is an alternative embodiment of the center sill shown in FIG. 1, including reinforcing doubler plates.
FIG. 11 is a top plan view of the portion of a center sill shown in FIG. 10.
FIG. 12 is a bottom plan view of the portion of a center sill shown in FIGS. 10 and 11.
FIG. 13 is a sectional view taken along line 13-13 of FIG. 11.
FIG. 14 is a sectional view taken along line 14-14 in FIG. 10, showing the location of a doubler plate attached to a horizontal filler plate.

Referring to FIGS. 7 and 8, the first main structural member 42 may be manufactured by cutting away portions of the plate to define the flanges 71 and 72, the sinuous margin 74 and the strap 76 at each end while the plate remains flat. The plate may then be bent along a pair of parallel bend lines 86 and 88 in the direction indicated by the arrows 89, to bring the side webs 46 and 48 upright and parallel with each other and to form radiused bends along the bend lines 86 and 88. For example, the corners along the bend lines 86 and 88 may have an inside radius of ¾ inch in steel plate having a thickness 44 of ⅜ inch. The width 90 of the narrower inboard portion 78 of the horizontal filler plate 68 is small enough to allow the filler plate to rest closely upon flat portions of the flanges 71 and 72 without being raised by the bends 86 and 88. Thus, for example, the width 90 of the inboard portion 78 may be 1½ inch less than the width 82 of the outwardly extending portion 80.

As shown in broken line in FIG. 7 a narrow strap 92 may be left between the flanges 71 and 72 to aid in stabilizing the first main structural member 42 during the process of bending it along the bend lines 86 and 88. The narrow strap 92 may be removed once the bends have been made and before assembly of the center sill 28.

As may be seen clearly in FIG. 9, the top cover plate 58 extends beyond the end 54 by a distance 64, and the horizontal filler plate 68 extends longitudinally outward a greater distance 69 beyond the end 54 of the side webs 46 and 48, so that when the center sill 28 is mated with the stub sills 24 and 26 there is no weld joint that extends continuously the entire distance around either end of the center sill 28 at a single location along the length of the center sill assembly 22.

Referring to FIGS. 10-14, a center sill 93 is an alternative embodiment of the structure disclosed herein, and a longer portion of the center sill 93 is shown in FIGS. 10-13 than is shown of the center sill 28 in FIGS. 2-5. Except for differences from the center sill 28, the same reference numerals will be used in respect of the center sill 93 in the following description. A diamond shaped doubler plate 94 is shown fastened to the top of the top cover plate 58 of the center sill 93, as by being welded along the entire periphery of the doubler plate 94. The doubler plate 94 is spaced apart from the end 54 by a distance related to the location of the slope sheet 36, where the center sill 93 is exposed to greater loading in a car body such as the hopper car body 20.

At each of the opposite ends 52 and 54 of the center sill 93 a horizontal filler plate 96 is shorter than the horizontal filler plate 68 of the center sill 28. An inboard portion 98 of the filler plate 96 may have a length 100 of, for example, about 44¼ inches. Correspondingly, the flanges 102 and 104 are about 44 inches in length to the sinuous margin 106. The strap 108, corresponding to the strap 76, may be located about 22 inches from the end 52 or 54, near the middle of the lengths of the flanges 71 and 72. For inclusion of a similarly constructed center sill 28 in a longer hopper car having three cargo hoppers 30, there would correspondingly be two more spaced-apart locations where the center sill 28 or 93 is exposed between slope plates of adjacent hoppers, and where the center sill 93 thus would have to carry greater loads because of the lack of support from adjacent structural members of the hoppers to carry train loads.

Similarly, adjacent each end of the center sill 93, a doubler plate 110 is fastened, as by being welded, to the top of the horizontal filler plate 96. The doubler plate 110 may be welded in the correct position on the inner, or top side of the inboard portion 48 of the horizontal filler plate 96 before the filler plate 96 is welded into place. The doubler plates 94 and 110 may be "diamond" -shaped, that is, tapered in each direction longitudinally from a short full-width central portion and having opposite longitudinally-extending pointed ends, so as to extend the connection of each doubler plate 94 or 110 respectively to the top cover plate 58 or the horizontal filler plate 96 over a long enough portion thereof to limit and graduate stress concentrations. The doubler plates 94 and 110 may be of metal plate of a thickness similar to the thickness 44 of the first main structural member, or the thickness 62 of the top cover plate 58.

In assembling the center sill 28 or 93, the horizontal filler plate 68 or 96 is attached by welding along the margins of the flanges 71 and 72 and the sinuous margin 74 entirely on the outer, or bottom face of the horizontal filler plate 68 or 96, preferably with the first main structural member 42 inverted. A fillet weld provides a sufficiently strong joint, between the bottom cover portion 50 of the first main structural member 42 and the filler plate 62 or 96, and can readily be inspected during the life of the car body 20.

With the first main structural member 42 upright, the top cover plate 58 may be placed atop the locator plates 66 and then welded easily and securely to the inner face of the upper margins 60 of the side web portions 46 and 48, which may extend a small distance above the top surface of the top cover plate 58. For example, when the thickness 62 of the top cover plate 58 and the thickness 44 of the side web portions 46 and 48 are both ⅜ inch, a 5⁄16 inch fillet weld along the entire length of each of the side web portions 46 and 48 may be used to fasten the top cover plate 58 in place.

As will be readily apparent, the process of assembling the center sill 28 is relatively simple by comparison with the conventional assembly of four plates into a box beam for a center sill, and the resulting structure offers the additional solidity of the bends 86 and 88 instead of welds along the bottom longitudinal edges of the center sill 28 or 93. At the same time, the use of slightly thinner plate in the first main structural member 42, with the doubler plates 94 and 110 as reinforcements at critical locations, provides ample strength, yet provides a center sill structure 28 or 93 that is significantly lighter in weight and a car body 20 that is less costly, both to build and to move along a railway.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A center sill for a railroad freight car, comprising:

(a) a first main structural member of plate metal having a length and a pair of opposite ends, and including a pair of parallel, longitudinally-extending bends defining a horizontal bottom cover portion and a pair of opposite upwardly extending side web portions;

(b) a horizontal top cover in the form of a flat plate spaced upwardly apart from the bottom cover portion and extending longitudinally between the side web portions, the top cover having opposite lateral margins each welded to a respective one of the side web portions, thereby forming an elongate box beam structure; and (c) a horizontal filler plate overlapping and welded to the bottom cover portion adjacent a respective one of the opposite ends of the first main structural member.

2. A center sill for a railroad freight car, comprising:

(a) a first main structural member of plate metal having a length and a pair of opposite ends, and including a pair of parallel, longitudinally-extending bends defining a horizontal bottom cover portion and a pair of opposite upwardly extending side web portions;

(b) a horizontal top cover plate spaced upwardly apart from the bottom cover portion and extending longitudinally between the side web portions, the top cover plate having opposite lateral margins each joined to a respective one of the side web portions, thereby forming an elongate box beam structure; and (c) a horizontal filler plate overlapping and joined with the bottom cover portion adjacent a respective one of the opposite ends of the first main structural member, and wherein the bottom cover portion of the first main structural member includes a horizontal flange adjacent the respective one of the opposite ends, and wherein the horizontal filler plate rests atop the horizontal flange and a margin of the horizontal flange is welded to the horizontal filler plate.

3. The center sill of claim 2, including a pair of the horizontal flanges directed laterally inwardly toward each other, the horizontal filler plate extending longitudinally between the side web portions and resting atop both of the flanges, and a respective margin of each of the flanges being welded to the horizontal filler plate.

4. The center sill of claim 3, wherein an inner end of the horizontal filler plate lies atop a transversely extending margin of the bottom cover portion of the first main structural member at a location spaced longitudinally inward from the respective one of the pair of ends of the first main structural member, and wherein the transversely extending margin of the bottom cover portion is welded to the bottom filler plate.

5. The center sill of claim 3, wherein the first main structural member includes a transverse strap extending horizontally between the flanges at a location spaced inwardly longitudinally apart from the respective one of the pair of ends of the first main structural member.

6. The center sill of claim 5, wherein the flanges have respective lengths and the transverse strap is located near a middle part of the lengths of the flanges.

7. The center sill of claim 2, wherein the first main structural member is a metal plate having a first thickness and the horizontal filler plate has a second thickness that is greater than the first thickness.

8. The center sill of claim 7, wherein the horizontal filler plate has a longitudinally inner portion located between the side web portions and having a first width that is less than a separation distance between the side web portions, and wherein the horizontal filler plate has a longitudinally outer portion extending longitudinally outward beyond the respective one of the pair of ends of the first main structural member and extending laterally outward to a greater second width that is at least equal to the separation distance between the side web portions.

9. The center sill of claim 2, wherein the top cover plate extends longitudinally outward beyond the opposite ends of the first main structural member.

10. The center sill of claim 2 wherein the horizontal top cover plate is parallel with the bottom cover portion.

11. The center sill of claim 2, wherein the horizontal filler plate has a longitudinally inboard part located between the side web portions and joined with a portion of the bottom cover portion of the first main structural member and a part extending longitudinally outwardly from the respective one of the opposite ends of the first main structural member.

12. The center sill of claim 2 wherein the top cover plate extends longitudinally outward beyond each end of the first main structural member.

13. The center sill of claim 2 including a doubler joined to the horizontal filler plate.

14. A method for making a center sill assembly for a railroad freight car, comprising:

(a) providing a first plate having a pair of opposite ends, a predetermined length, and a predetermined width;

(b) bending the first plate along a pair of longitudinal bend lines to form a pair of parallel side web portions and a bottom cover portion of a first main structural member;

(c) placing a top cover portion in the form of a flat plate between upper margins of the side web portions and welding opposite lateral margins of the top cover portion to respective ones of the side web portions, thereby forming a box beam structure for a center sill; and (d) welding a horizontal filler plate to the bottom cover portion at a respective one of the opposite ends of the first main structural member, so that the horizontal filler plate extends longitudinally outward from the bottom cover portion beyond the respective one of the opposite ends.

15. A method for making a center sill assembly for a railroad freight car, comprising:

(a) providing a first plate having a pair of opposite ends, a predetermined length, and a predetermined width;

(b) bending the first plate along a pair of longitudinal bend lines to form a pair of parallel side web portions and a bottom cover portion of a first main structural member and cutting away a part of the bottom cover portion of the first plate adjacent the respective one of the opposite ends, so as to form a pair of laterally inwardly directed flanges;

(c) placing a top cover portion between upper margins of the side web portions and joining the top cover portion to both of the side web portions, thereby forming a box beam structure for a center sill; and (d) joining a horizontal filler plate to the bottom cover portion at a respective one of the opposite ends of the first main structural member by placing the horizontal filler plate between the side webs and welding respective margins of the flanges to the horizontal filler plate, so that the horizontal filler plate extends longitudinally outward from the bottom cover portion beyond the respective one of the opposite ends.

16. The method of claim 15 wherein the horizontal filler plate is thicker than the first plate.

17. The method of claim 15 wherein the step of cutting away a part of the bottom cover portion of the first plate includes leaving a part of the bottom cover portion as a transverse connecting strap interconnecting the flanges with each other, and including the further step of welding the connecting strap to the filler plate as a part of the step of joining the filler plate to the bottom cover portion of the first main structural member.

* * * * *